US008262906B2

(12) United States Patent
Davidson

(10) Patent No.: US 8,262,906 B2
(45) Date of Patent: Sep. 11, 2012

(54) FLOW SELECTION DEVICE FOR USE WITH POOLS AND THE LIKE

(75) Inventor: Dan Davidson, Elanora (AU)

(73) Assignee: Davbroz Pty Ltd., Queensland (AU)

( * ) Notice: Subject to any disclaimer, the term of this patent is extended or adjusted under 35 U.S.C. 154(b) by 443 days.

(21) Appl. No.: 12/312,475

(22) PCT Filed: Nov. 9, 2007

(86) PCT No.: PCT/AU2007/001721

§ 371 (c)(1),
(2), (4) Date: Feb. 1, 2010

(87) PCT Pub. No.: WO2008/055312

PCT Pub. Date: May 15, 2008

(65) Prior Publication Data

US 2010/0126918 A1 May 27, 2010

(30) Foreign Application Priority Data

Nov. 10, 2006 (AU) ..... 2006906291

(51) Int. Cl.
*E04H 4/12* (2006.01)

(52) U.S. Cl. ..... 210/167.15; 4/507

(58) Field of Classification Search ..... 210/167.15, 210/232; 4/507

See application file for complete search history.

(56) References Cited

U.S. PATENT DOCUMENTS

| | | | | |
|---|---|---|---|---|
| 3,749,244 | A * | 7/1973 | Jannuzzi, Jr. | 210/167.11 |
| 4,479,274 | A | 10/1984 | Biby | |
| 6,009,573 | A | 1/2000 | Thibault | |
| 6,022,481 | A * | 2/2000 | Blake | 210/776 |
| 6,230,337 | B1 | 5/2001 | Barnett | |
| 6,738,994 | B2 | 5/2004 | Barnett et al. | |
| 2004/0000525 | A1 * | 1/2004 | Hornsby | 210/776 |
| 2008/0230454 | A1 * | 9/2008 | Nibler et al. | 210/167.12 |

FOREIGN PATENT DOCUMENTS

| | | | |
|---|---|---|---|
| AU | 2007100387 | A4 | 6/2007 |
| WO | WO 2004/009934 | A1 | 1/2004 |

OTHER PUBLICATIONS

International Search Report dated Jan. 22, 2008 in connection with PCT Patent Application No. PCT/AU2007/001721.

Written Opinion of the International Searching Authority dated Jan. 22, 2008 in connection with PCT Application No. PCT/AU2007/001721.

* cited by examiner

*Primary Examiner* — Fred Prince

(57) ABSTRACT

A flow selection device for removal of detritus from a body of water, the device including at least one inlet manifold having a forward face with an opening, at least one outlet located in an upper rear portion of the device and at least one chamber located between the at least one inlet and at least one outlet and defining an annodated flow path between the opening in the forward face and the at least one outlet.

25 Claims, 7 Drawing Sheets

FLOW SELECTION DEVICE FOR USE WITH POOLS AND THE LIKE

CROSS-REFERENCE TO RELATED APPLICATION(S)

The present application claims priority under 35 U.S.C. §365 to International Patent Application No. PCT/AU2007/001721 filed Nov. 9, 2007, entitled "FLOW SELECTION DEVICE FOR USE WITH POOLS AND THE LIKE". International Patent Application No. PCT/AU2007/001721 claims priority under 35 U.S.C. §365 and/or 35 U.S.C. §119(a) to Australian Patent Application No. 2006906291 filed Nov. 10, 2006 and which are incorporated herein by reference into the present disclosure as if fully set forth herein.

FIELD OF THE INVENTION

The present invention relates to the cleaning of pools, spas and other bodies of water of leaves and the like which fall into the water.

BACKGROUND ART

The use of pool skimmers is known in the prior art. More specifically, pool skimmers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,822,487; U.S. Pat. No. 4,846,972; U.S. Pat. No. 5,342,513; U.S. Pat. No. Des. 330,444; U.S. Pat. No. 5,084,177; and U.S. Pat. No. 3,220,037.

As stated in U.S. Pat. No. 5,342,513, owners of pools and hot tubs frequently encounter floating debris which must be removed. The floating debris is often manually removed with a skimmer net attached to a long handle. In addition, many pools continuously filter the pool water by circulating it through perforated skimmer baskets that are held in wells formed in the pool sides. Floating debris is captured inside the skimmer baskets, while the pool water drains through the perforations in the baskets and back into the pool. As debris collects in the skimmer baskets, the basket perforations can become clogged to the point where water will no longer flow out of the skimmer baskets so that filtration of debris from the pool water ceases.

Devices of the abovementioned kind are useful for the collection of floating detritus such as leaves and the like, but due to the location of the skimmer basket in the wells formed at the side of the pools, they are not well suited to the removal of material which may be semi-suspended or even detritus which has settled to the bottom of the body of water.

Devices are available in the art which are directed to the removal of this kind of semi-settled or sunken detritus. One of the major problems with devices of this kind is the provision of a device which works efficiently but is also safe for swimmers in the pool while the device is active. Many of the devices have openings for the detritus and/or the intake of liquid which are also dangerous for swimmers, particularly younger children who insert their hands into the intake opening. Due to their hands and arms being smaller in size than an adult's hand and arm, the child's hand can penetrate further into the device to the point where serious injury can be caused by the mechanism.

It will be clearly understood that, if a prior art publication is referred to herein, this reference does not constitute an admission that the publication forms part of the common general knowledge in the art in Australia or in any other country.

SUMMARY OF THE INVENTION

The present invention is directed to a flow selection device for use with pools and the like, which may at least partially overcome at least one of the abovementioned disadvantages or provide the consumer with a useful or commercial choice.

In one form, the invention resides in a flow selection device for removal of detritus from a body of water, the device including:

i. At least one inlet manifold having a forward face with an opening, ii. At least one outlet located in an upper rear portion of the device and iii. at least one chamber located between the at least one inlet and at least one outlet and defining an annodated flow path between the opening in the forward face and the at least one outlet.

The device of the present invention is best described with reference to its use in a swimming pool although the invention is not limited to this use. Hereinafter, reference to the term "pool" or derivatives is not intended to limit the scope of the use of the device and may include spa baths and other water holding chambers. The invention is limited to pools according to one very specific embodiment only.

In the present specification and claims (if any), the word "annodated" and its derivatives is defined as substantially S-shaped or circuitous.

The device of the present invention is preferably adapted to be included in a system for removal of detritus from a body of water. The device of the present invention is preferably associated with a filtration system which may be in fluid communication with the body of water and which is adapted to intake water from the body of water, filter the water and then return the water to the body. There is normally a suction pump associated with the filtration system which is located remotely from the body of water. It is important to note that the suction device of the invention will not normally impose the suction on the body of water, nor will the device of the invention actively clean the water or remove detritus itself, but is adapted to provide a flow path through which the water to be cleaned flows.

The device according to the invention preferably has an elongate body portion with a generally box-shaped configuration and possessing a forward face being the poolside face. The body portion generally has a pair of opposed sidewalls, a front wall, and a rear wall. It will typically be connected to form part of a filtration system having a pump and inline filtration equipment.

The body portion will preferably be substantially the height of the body of water. At or adjacent a lower end of the body portion is preferably connection means to connect at least one and normally more than one inlet arm. The connection means preferably includes an opening for each inlet arm.

According to a particularly preferred embodiment of the present invention, the body portion is an elongate hollow box section having a front wall, a rear wall and a pair of opposed side walls, an open top and a closed bottom. The body portion has a central bore. The body portion of this embodiment includes a pair of opposed lateral extension portions, each extending from at or adjacent a lower end of the body portion and from each of the side walls. Each of the extension portions is also a hollow box section with a central bore in fluid communication with the central bore of the body portion. The extension portions are each adapted to engage with an inlet arm to positively locate the inlet arm in relation to the body portion.

Suitably, at least a portion of each inlet arm will be received within, or receive a portion of, an extension portion. Preferably, the inlet arms will fit over the extension portions.

The body portion will preferably be associated with a removably connected cap section which will preferably attach to the body portion and also mount the connections to the filter system and the pump/suction source. The cap section will suitably be located above water level when attached to the body portion and the body portion is properly located in the body of water.

Suitably, the cap section will typically possess a neck portion which is adapted to be at least partially received within an upper portion of the hollow body portion. There will also usually be a laterally extending shoulder portion, which when the cap portion is in position, will abut the upper edge of the sidewalls defining the opening of the hollow body portion.

At least one opening will generally be provided in the cap portion in order to attach the connections to the filter system and the pump/suction source and also the automatic cleaner attachment. There will typically be an opening on the poolside face of the cap portion to allow insertion of a pipe from an automated cleaner such as a Barracuda™-type pool cleaner. The opening will typically include a hinged flap to occlude or cover the opening when the pipe of the pool cleaner is not attached and the flap will typically be associated with a shut-off valve to prevent suction in the opening when the flap is in the closed position when the pipe is removed. The flap will typically be biased into the closed condition. There may be one or more sealing means such as an O-ring or similar provided in association with the opening to seal the pipe of the pool cleaner when inserted to the cap portion.

The cap portion preferably also functions to divert operation between the automatic pool cleaner when connected and the inlet arms when the automatic pool cleaner is not connected. Preferably, the default operative condition is that the pump means or filter system is in fluid connection with the inlet arms unless the automatic pool cleaner in attached. When attached, the pipe of the automatic pool cleaner may cover the access to the inlet arms preventing the intake of water through the inlet arms whilst allowing the automatic pool cleaner to function. Removal of the pipe of the automatic pool cleaner from the cap portion preferably removes the occlusion, allows the flap to close, returning operation to the inlet arms.

As stated above, at least one and normally more than one inlet arm is provided at or adjacent a lower end of the body portion. Each inlet arm will preferably include an inlet manifold with an opening.

The manifold(s) will normally be mounted in a sidewall of the container holding the body of water. For example, a swimming pool has a bottom with at least one upstanding sidewall depending upon whether the sidewall is arcuate or not. The sidewall is generally vertical and the manifold of the device of the invention is preferably mounted to or in a sidewall.

In order to minimise the visibility of the manifold for aesthetic purposes, the manifold may be mounted to be flush or co-planar with the sidewall of the container.

If the device is included in a newly constructed pool, the manifold may be mounted prior to the application of the surface finish applied to the inside surface of the container. Therefore, when applied, the surface coating of the inside surface will generally cover the manifold except for the opening therein, disguising the manifold. The manifold may also be shaped to match the contour of the inside of the pool surface.

The device of the invention and the manifold in particular may be manufactured of any suitable material. However, given the environment of the body of water, materials may be specifically chosen to resist the environment. Preferred materials are likely to include light metals but plastics will generally be more preferred.

As stated above, the forward face of the manifold is the face oriented inwardly towards the centre of the container or pool holding the water. The forward face may be planar and will generally be solid except for the opening therein.

The opening in the forward face will typically be one or more elongate slots or similar aligned with the longer dimension of the manifold to be substantially vertical, although the opening may extend in any direction. It is preferred that the opening be covered so as to prevent the insertion of articles including a person's finger for example, into the opening.

The opening will typically be substantially centrally located in the forward face of the manifold, but not necessarily. More preferred is that the opening be provided towards an outer end of an inlet arm. The inlet arm will preferably be at least 500 mm in length such that if two inlet arms are provided on opposed sides of the body portion, the openings would be spaced apart by at least 1100 mm according to the applicable Australian standard. Different dimensions may be utilised in other countries.

There may preferably be an access panel or wall to the internal portion of the device to allow for cleaning or maintenance of the device if required.

The opening in the forward face is preferably the inlet to the device through which the water flows inwardly and accesses the filtration system. The opening is typically in fluid communication with the suction side of a pump of the filtration system to draw the liquid through the device and thence through the filtration system.

The device also includes an outlet located in an upper rear portion. The outlet is typically in fluid communication with a pump of the filtration system. The outlet will normally be in or through the rear wall of the device. The outlet may be of any configuration for example a pipe or other similar conduit.

The annodated flow path through the particularly preferred form of the device is typically provided between the opening in an inlet arm, and the outlet by the water travelling into the opening in the inlet arm, along the inlet arm, up through the body portion and then rearwardly through the outlet.

The device of the invention may be further associated with a leaf collector. Preferably the leaf collector may be provided downstream of the device in the flow path. The outlet of the device of the invention may therefore be associated with an inlet to the leaf collector.

The leaf collector will typically have a removable filter element to catch leaves or other detritus. The fluid preferably flows into the leaf collector at an upper portion and out through an outlet located at a lower portion of the collector. The flow then proceeds to the remainder of the filter system.

According to preferred embodiments, there will be two main situations in which the suction apparatus or system of the present invention will be installed, namely a new installation or installation in a new pool and a retrofit situation where the suction system is installed into an existing completed pool. Accordingly, the installation procedure as well as the system configuration and components may differ in each situation.

In the new installation in a new pool, the majority of the components of the system will be installed prior to the pool surface layer being applied to the pool and therefore, most of the components will typically be hidden. In particular, the only components visible after completion of the pool will preferably be the inlet opening(s) and the forward opening in the cap section or top box allowing connection for the pool cleaner pipe if provided.

Normally, during installation of the system in this embodiment, the body portion and inlet arm(s) are installed prior to the pool surface layer being provided. A blanking plug or similar will normally be placed in the inlet opening temporarily so that the pool surface coating when applied, does not block the inlet opening(s). Once the pool surface coating has been applied and has set, the blanking plug can be removed and an inlet opening cover or grill or similar provided to cover the inlet opening to limit the ingress of detritus or fingers for example but allow fluid to flow therethrough. This method will typically result in the finished system having a pair of covered openings spaced apart towards the base of the pool wall.

The remainder of the system, namely the inlet arms, body portion, and cap section or top box will also be provided behind the pool surface layer and possibly outside the shell of the pool. In order to connect a pool cleaner pipe if provided, the forward opening of the cap section or top box will typically be provided with an attachment extension, one end of which is in communication with the forward opening of the top box and a second end which extends forwardly of the pool surface.

The second end of the attachment extension may be threaded or provided with attachment means to attach the pool cleaner device. The second end will typically be provided with a temporary cover or similar to cover the opening to prevent flow into and out of the attachment extension. The cover may be a cap or similar and is attachable in any way to the attachment extension. The cap will typically be attached to the attachment extension such that when removed from the second end, the cap will remain attached to the attachment extension so it is not lost or misplaced.

According to the retrofit situation where the suction system is installed into an existing completed pool, the system may be installed with the majority of the components attached to the interior surface of a pool wall. In particular, the inlet arms, inlet openings and the body portion will all typically be attached to the pool wall. The components will preferably have a low profile in order to be as unobtrusive as possible.

The system may be provided as a hollow body portion which is in communication with the top box, and which extends substantially perpendicularly down the side of the pool. A T-shaped centre junction will normally be provided and attached to a lower end of the body portion with a lateral extension portion extending at approximately 90° to the body portion and along the wall.

The inlet arms are preferably connected to the lateral extension portions with an inlet opening terminus provided at the end of each inlet arm. Each inlet opening terminus has an opening in communication with the pool, said opening normally covered by a cover to limit the ingress of detritus or fingers for example but allow fluid to flow therethrough.

The top box of the preferred embodiment will typically be the same or similar according to each of the retrofit or new installation systems with the main difference residing in the length of the attachment extension.

The top box is preferably substantially rectangular and hollow with a forward opening on the pool side, a lower opening in communication with the body portion of the system, and an outlet opening on the opposite side to the pool side and in communication with a pool filtration system and suction pump as described earlier.

The top box will preferably have an internal divider wall located below the plane of the forward and outlet openings and dividing the top box into a lower portion into which fluid from the pool is initially drawn from the body portion through the lower opening and an upper portion in which the forward and outlet openings are located. The internal divider will preferably have an opening therethrough allowing fluid to pass from the lower portion into the upper portion. The lower opening, the opening in the internal divider and the outlet opening from the top box will also preferably form an annodated flow path through the top box.

The lower opening will also typically be substantially slot shaped and be located towards the pool side of the lower portion of the top box.

As stated above, the forward opening of the top box will normally be provided with an attachment extension to temporarily attach a pool cleaning device. The attachment extension extends forwardly of the top box, into the pool away from the pool wall. The attachment extension is preferably also provided with a valve body which is moveable in relation to the attachment extension and the opening in the internal divider of the top box to regulate and prevent flow through the body portion and into the outlet when the pool cleaning device is attached. The valve body does so by its position relative to the opening in the internal divider in the top box.

The default condition when the pool cleaning device is not connected is a fully open condition in which the opening in the internal divider is not restricted. When the pool cleaning device is not connected, the opening in the attachment extension is covered and fluid flows from the inlet openings in the inlet manifolds, through the inlet arms, body portion into the top box, through the opening in the internal divider and out of the outlet.

Movement of the valve body from the full open condition occludes the opening in the internal divider to an extent. A fully closed condition occludes the opening entirely drawing fluid into the top box through the attachment extension only. A partially open condition occludes the opening partially and in this manner the relative amounts of fluid drawn into the filtration system through the pool cleaning device and through the inlet openings in the manifolds can be adjusted.

The valve body is preferably closely received within the attachment extension and is typically elongate and tubular with an angled end located within the top box. The angled end provides the adjustment of the occlusion of the opening in the internal divider through rotation. Alternatively the valve body may be moved inwardly and outwardly to occlude the opening, rather than rotated.

The valve body is typically only adjusted from the fully open condition when the pool cleaner is attached as at all other times, the cap of the attachment extension will prevent flow through the attachment extension.

BRIEF DESCRIPTION OF THE DRAWINGS

Various embodiments of the invention will be described with reference to the following drawings, in which.

DETAILED DESCRIPTION OF THE PREFERRED EMBODIMENT

Figure 1:
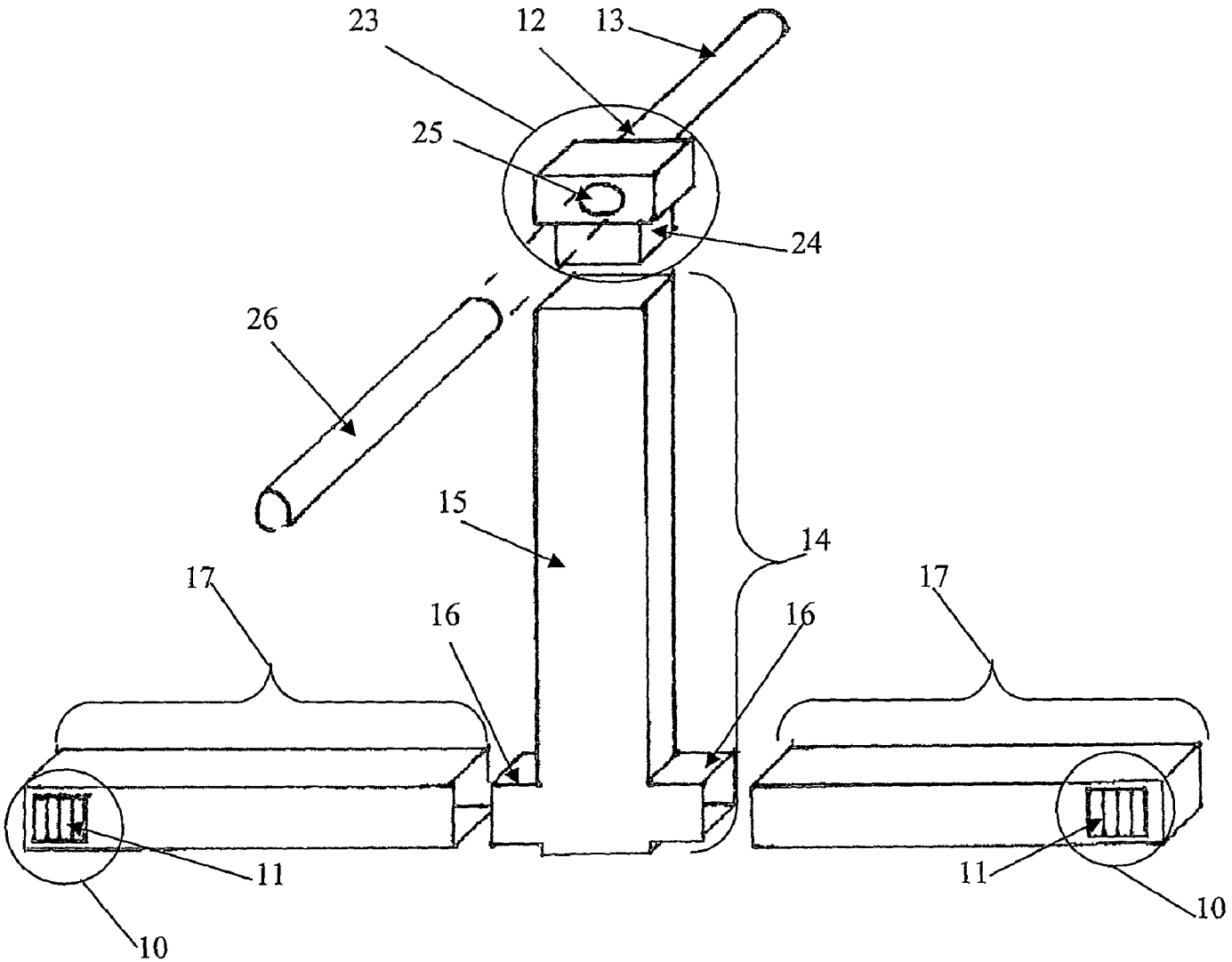
FIG. 1 is an exploded isometric view of a suction device according to a preferred embodiment of the present invention.

According to a preferred embodiment, a suction device for use with pools and the like is provided.

The suction device of the illustrated embodiment includes a pair of inlet manifolds 10 having a forward face with openings therein 11, an outlet 12 located in an upper rear portion of the device and a chamber located between the inlets 10 and the outlet 12 and defining an annodated flow path between the opening 11 in the forward face and the outlet 12.

The device of the present invention is best described with reference to its use in a swimming pool although the invention is not limited to this use.

The suction device of the present invention is adapted for removal of detritus from a body of water. The device of the illustrated embodiment is adapted for associated with a filtration system which is in fluid communication with the body of water and which is adapted to intake water from the body of water, filter the water and then return the water to the body. There is normally a suction pump (not shown) associated with the filtration system which is located remotely from the body of water. The water passing through the device of the present invention accesses the filtration system via an outlet pipe 13 which may also be an inlet pipe to a leaf collector as described below.

The device according to the illustrated embodiment has an elongate body portion 14 with a generally box-shaped configuration. The body portion 14 is substantially the height of the body of water.

According to the illustrated embodiment of the present invention, the body portion 14 is an elongate hollow box section having a front wall with a forward face 15, a rear wall and a pair of opposed side walls, an open top and a closed bottom. The body portion 14 also has a central bore or chamber. The body portion 14 of this embodiment includes a pair of opposed lateral extension portions 16, each extending from a lower end of the body portion 14 and from each of the side walls. Each of the extension portions 16 is also a hollow box section with a central bore in fluid communication with the central bore of the body portion 14. The extension portions 16 are each adapted to engage with an inlet arm 17 to positively locate the inlet arm 17 in relation to the body portion 14.

The inlet arms 17 fit over the extension portions 16.

The body portion 14 is associated with a removably connected cap section or top box 23 which attaches to the body portion 14 and also mounts the connection pipe 13 to the filter system and the pump/suction source from a rear part. The top box 23 is located above water level when attached to the body portion 14 and the body portion 14 is properly located in the body of water.

Suitably, the top box 23 possesses a neck portion 24 which is adapted to be at least partially received within an upper portion of the hollow body portion 14. There is a laterally extending shoulder portion, which when the top box 23 is in position, will abut the upper edge of the sidewalls, front wall and rear wall defining the opening at the top of the hollow body portion 14.

There is a forward facing opening 25 on the poolside face of the cap portion to allow insertion of a pipe from an automated cleaner such as a Barracuda™-type pool cleaner. The opening 25 includes a hinged flap to occlude or cover the opening when the pipe 26 of the pool cleaner is not attached and the flap is associated with a shut-off valve to prevent suction in the opening when the flap is in the closed position when the pipe 26 is removed. There is also sealing means such as an O-ring provided in association with the opening 25 to seal the pipe 26 of the pool cleaner when inserted to the top box 23.

The top box 23 also functions to divert operation between the automatic pool cleaner when connected and the inlet arms 17 when the automatic pool cleaner is not connected. Preferably, the default operative condition is that the pump means or filter system is in fluid connection with the inlet arms 17 unless the automatic pool cleaner is attached. When attached, the pipe 26 of the automatic pool cleaner covers the access to the inlet arms 17 preventing the intake of water through the inlet arms 17 whilst allowing the automatic pool cleaner to function. Removal of the pipe 26 of the automatic pool cleaner from the top box 23 removes the occlusion, allows the flap to close, returning operation to the inlet arms 17.

As stated above, each inlet arm includes an inlet manifold 12 with an opening 11.

The device in general but the manifolds 12 in particular will normally be mounted in a sidewall of the container holding the body of water. For example, a swimming pool has a bottom with at least one upstanding sidewall depending upon whether the sidewall is arcuate or not. The sidewall is generally vertical and the manifolds 12 of the device of the invention will usually be mounted to or in a sidewall.

In order to minimise the visibility of the manifold for aesthetic purposes, the manifold is preferably mounted to be flush or co-planar with the sidewall of the pool.

As stated above, the forward face of the manifold 12 is the face oriented inwardly towards the centre of the container or pool holding the water. The forward face may be planar and will generally be solid except for the opening therein.

The opening 11 in the forward face 15 of the illustrated embodiment takes the form of elongate slots aligned to be substantially vertical. It is preferred that the slots be covered so as to prevent the insertion of articles including a person's finger for example into the opening.

The opening 11 is provided towards an outer end of each inlet arm 17. The inlet arm 17 is at least 500 mm in length such that if two inlet arms 17 are provided on opposed sides of the body portion 14 as illustrated in FIG. 1, the openings 11 are spaced apart by at least 1100 mm according to the applicable Australian standard.

The device also includes an outlet 13 located in an upper rear portion of the cap portion 23.

The annodated flow path through the illustrated form of the device is provided between the opening 11 in an inlet arm 17, and the outlet 12 by the water travelling into the opening 11 in the inlet arm 17, along the inlet arm 17, up through the body portion 14 and then rearwardly through the outlet 12.

Figure 2:
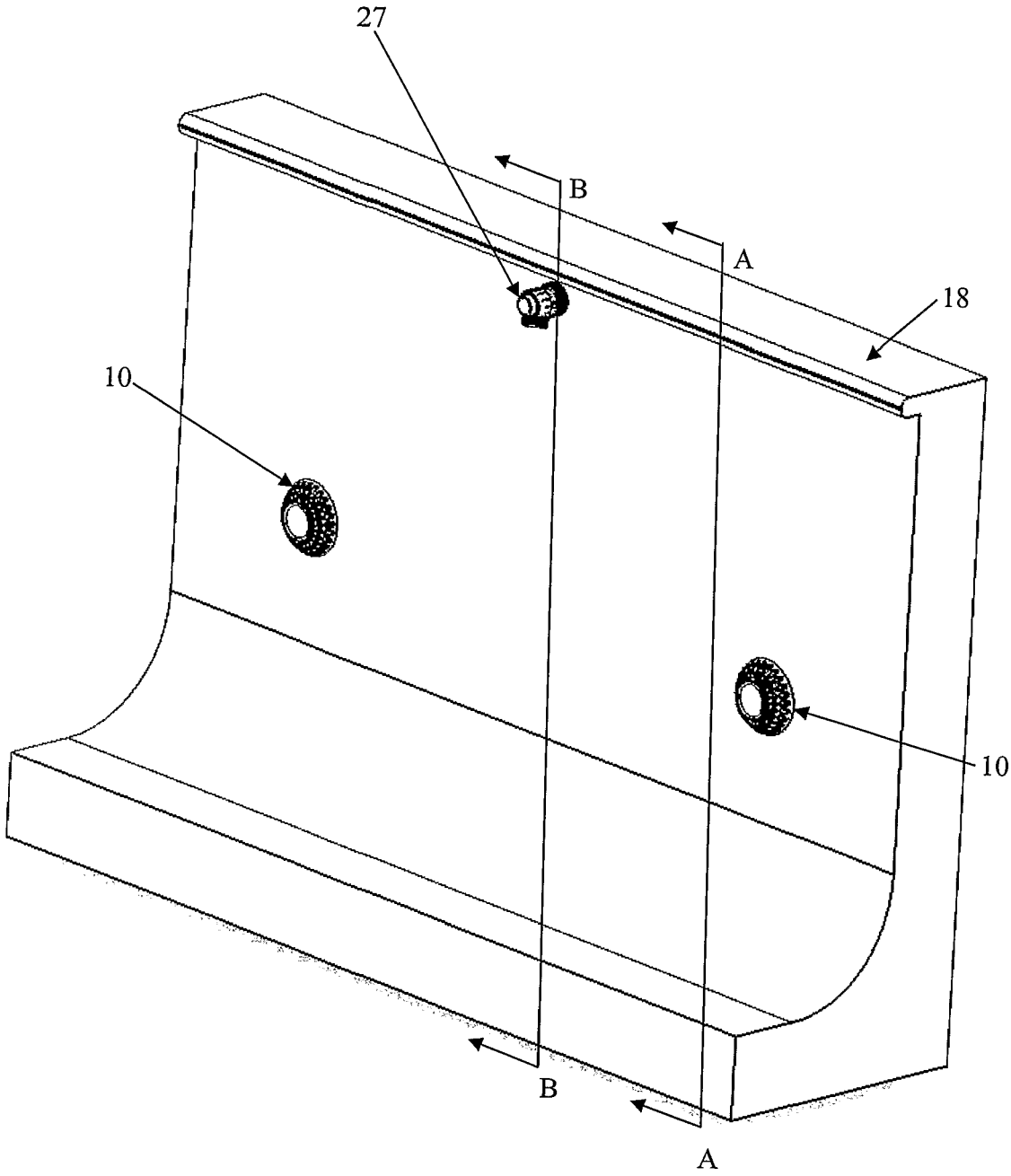
FIG. 2 is a perspective view of a suction system according to a preferred embodiment of the present invention fitted in a new pool installation.
Figure 3:
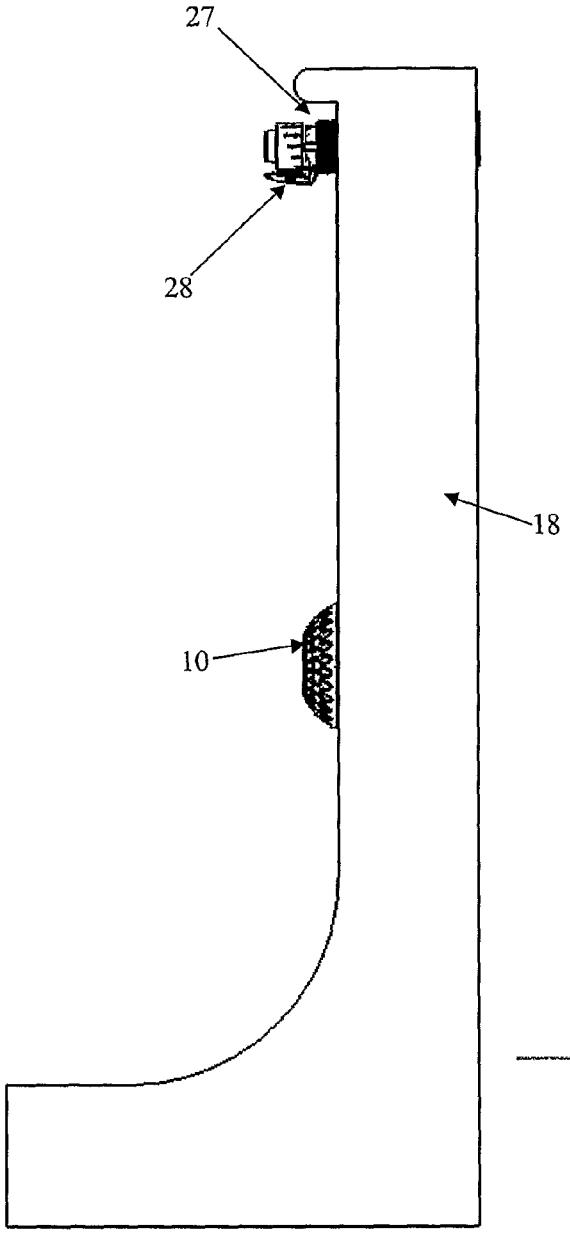
FIG. 3 is a cross-sectional view of the pool installation illustrated in FIG. 2 along line A-A.
Figure 4:
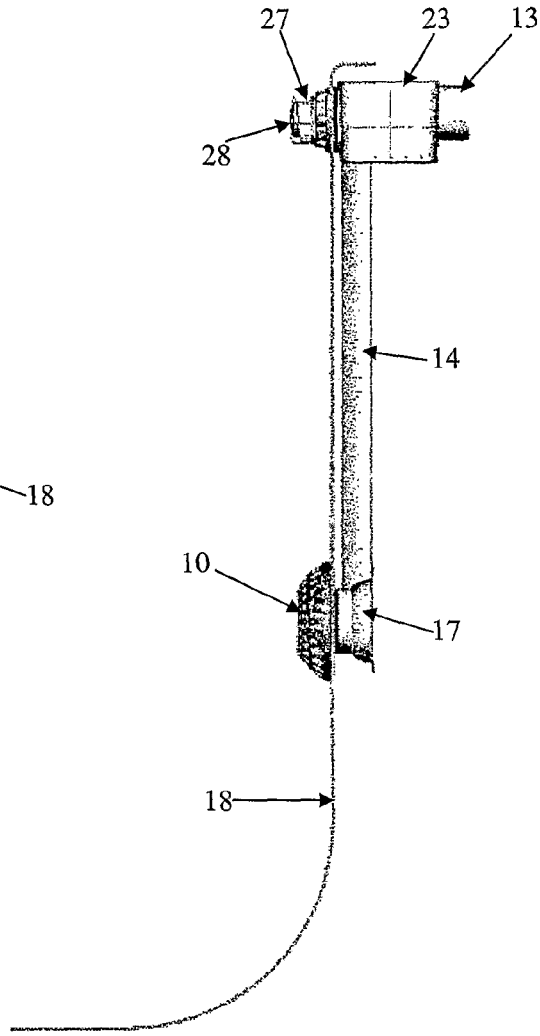
FIG. 4 is a cross-sectional view of the pool installation illustrated in FIG. 2 along line B-B.
Figure 5:
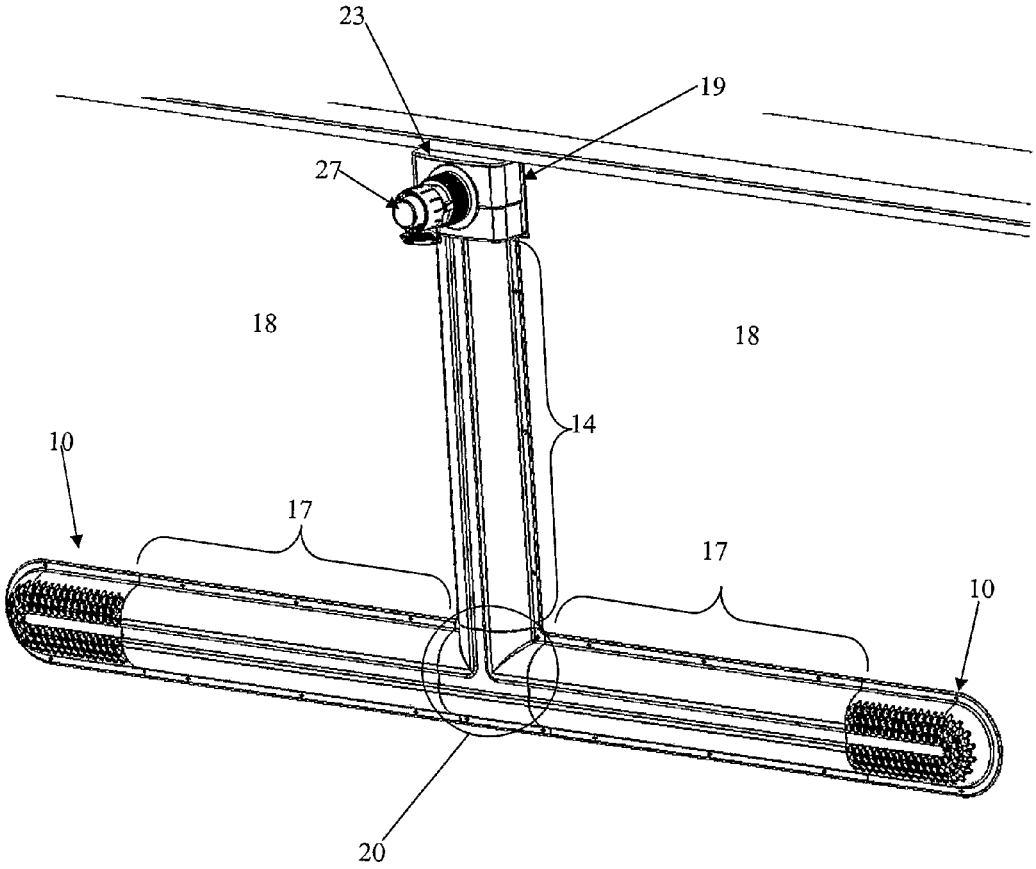
FIG. 5 is a perspective view of a suction system according to a preferred embodiment of the present invention retrofitted into an existing pool installation.

According to preferred embodiments, there will be two main situations in which the suction apparatus or system of the present invention will be installed, namely a new installation or installation in a new pool, forms of which are illustrated in FIGS. 2 to 4 and a retrofit situation where the suction system is installed into an existing completed pool, a general form of which is illustrated in FIG. 5.

In the new installation in a new pool, the majority of the components of the system are installed prior to the pool surface layer being applied to the pool and therefore, most of the components are hidden. As illustrated in FIG. 2, the only components visible after completion of the pool are the inlet manifolds 10 and an outer portion of an attachment extension 27 to the top box 23 allowing connection for the pool cleaner pipe 26 if provided.

The remainder of the system, namely the inlet arms 17, body portion 14, and top box 23 are provided behind the pool wall 18. In order to connect a pool cleaner pipe 26, one end of the attachment extension 27 is in communication with the forward opening of the top box 23 (which are not illustrated in FIG. 2 but are in FIG. 4) and a second outer end which extends forwardly of the pool surface.

According to the embodiment illustrated in FIGS. 2 and 3, the second end of the attachment extension 27 is provided with attachment means to attach the pool cleaner device. The second end has a temporary cover 28 to cover the opening to prevent flow into and out of the attachment extension 27. The cover 28 is attached to the attachment extension 27 such that when removed from the second end, the cover 28 remains attached to the attachment extension 27 so it is not lost or misplaced.

According to the retrofit situation illustrated in FIG. 5, the suction system is installed into an existing completed pool. The system is installed with the majority of the components attached to the interior surface of a pool wall. In particular, the inlet arms 17, inlet manifolds 10 and the body portion 14 are all 25, attached to the surface of the pool wall 18.

As illustrated, the hollow body portion 14 is in communication with the top box 23 which is mounted in a cavity 19 in an upper portion of the pool wall 18. The body portion 14 extends substantially perpendicularly down the side of the pool 18. A T-shaped centre junction 20 is provided and attached to a lower end of the body portion 14 with a lateral extension portion extending at approximately 90° to the body portion 14 and along the wall 18.

The inlet arms 17 are connected to the lateral extension portions with an inlet manifold 10 provided at the end of each inlet arm 17. Each inlet manifold 10 has an opening in communication with the pool, the opening normally covered by a cover to limit the ingress of detritus or fingers for example but allow fluid to flow therethrough.

Figure 6:
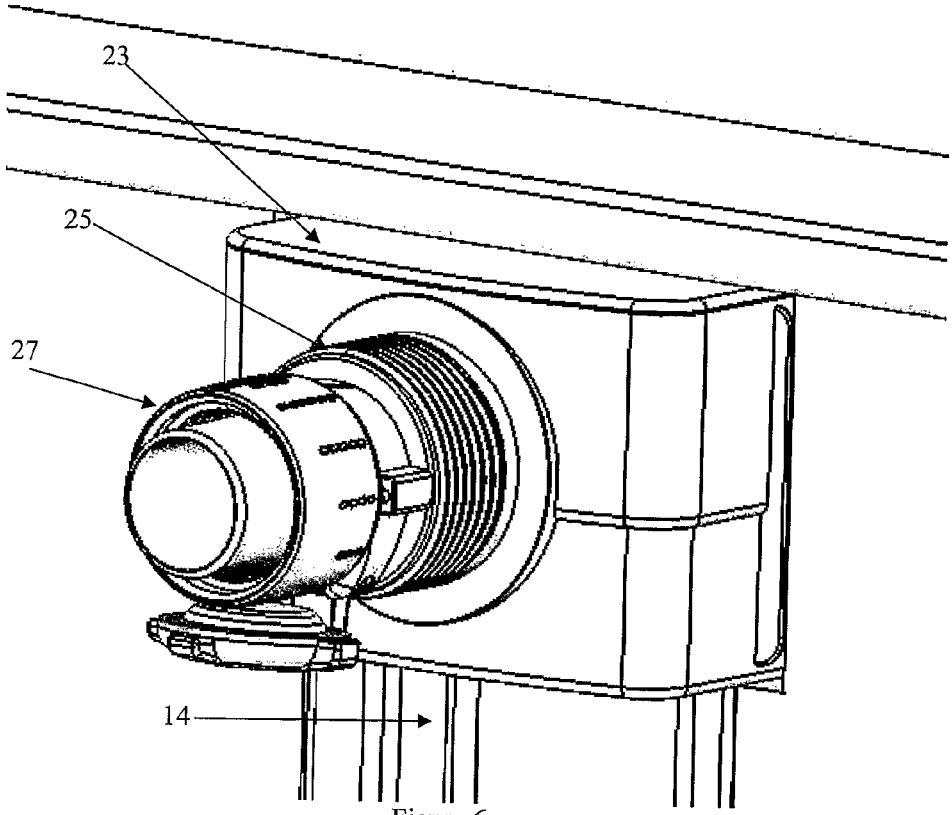
FIG. 6 is a close-up perspective view of the top box of the suction system of a preferred embodiment in the valve closed condition.
Figure 7:
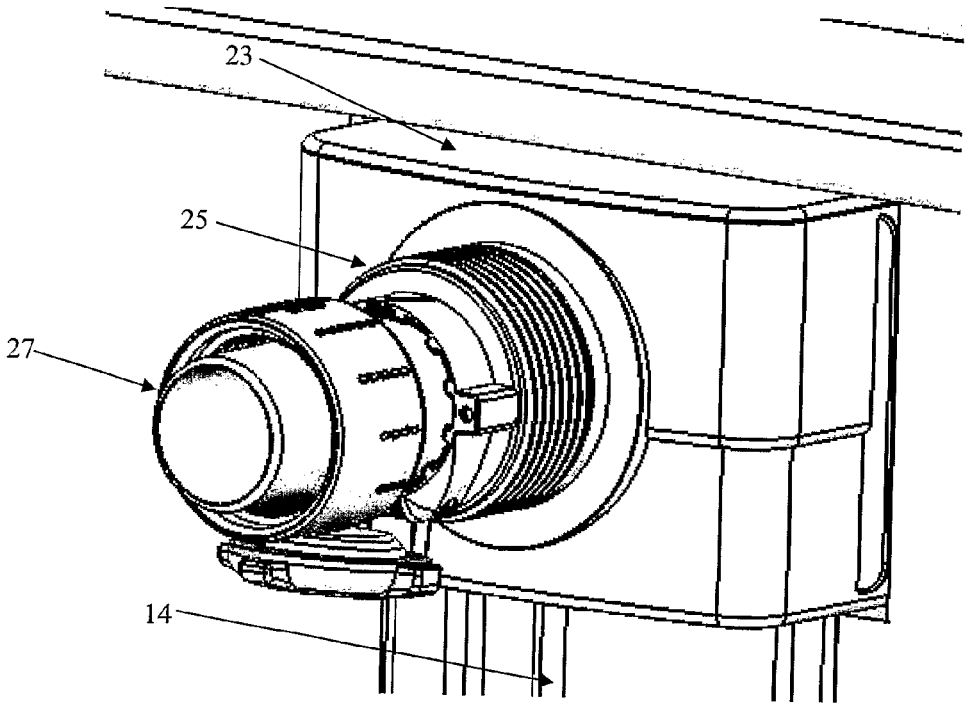
FIG. 7 is a close-up perspective view of the top box of the suction system of a preferred embodiment in the valve open condition.
Figure 8:
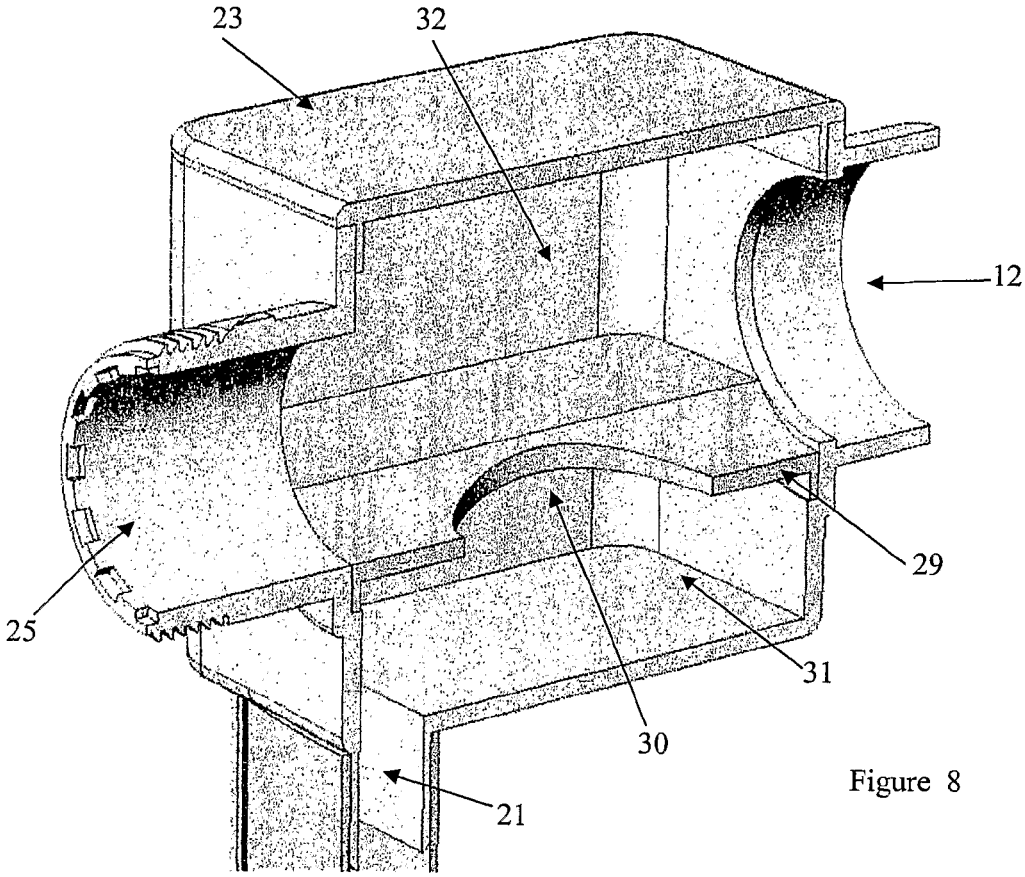
FIG. 8 is a sectional view of the top box illustrated in FIGS. 6 and 7 with the valve body removed.
Figure 9:
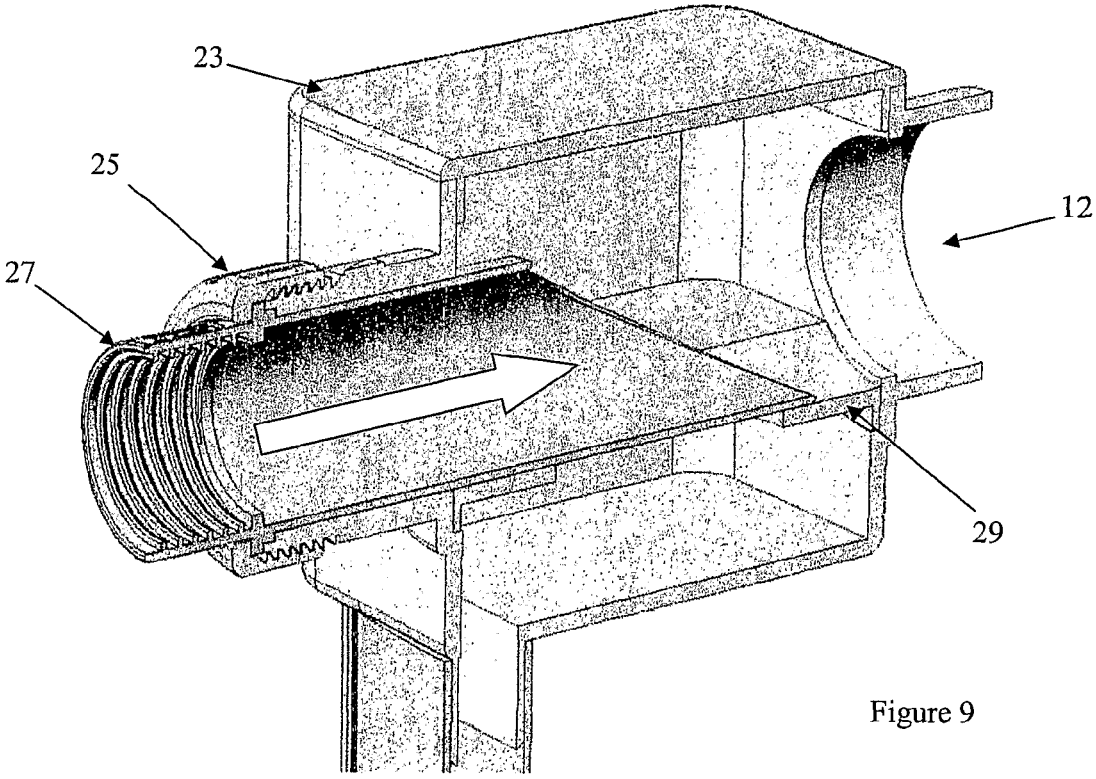
FIG. 9 is a sectional view of the top box illustrated in FIGS. 6 and 7 with the valve body in the closed condition.
Figure 10:
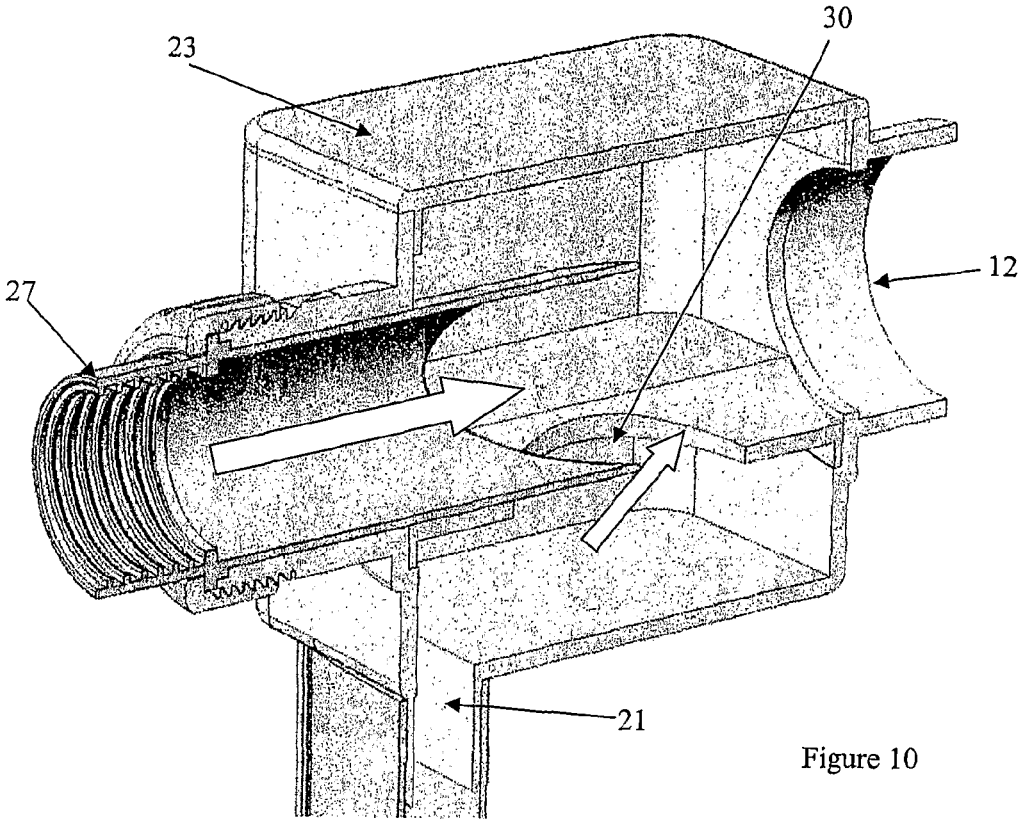
FIG. 10 is a sectional view of the top box illustrated in FIGS. 6 and 7 with the valve body in the half open condition.

The top box 23 of the preferred embodiment will typically be the same or similar according to each of the retrofit or new installation systems with the main difference residing in the length of the attachment extension 27. A preferred form of top box 23 is illustrated in detail in FIGS. 6 and 7 with the function of the top box illustrated in FIGS. 8 to 11.

The illustrated top box 23 is substantially rectangular and hollow with a forward opening 25 on the pool side, a lower opening 21 in communication with the body portion 14, and an outlet opening 12 on the opposite side to the pool side and in communication with a pool filtration system and suction pump as described earlier.

As illustrated in FIGS. 8 to 11, the top box 23 has an internal divider wall 29 located below the plane of the forward 25 and outlet openings 12 and dividing the top box 23 into a lower portion 31 into which fluid from the pool is initially drawn from the body portion 14 through the lower opening 21 and an upper portion 32 in which the forward 25 and outlet openings 12 are located. The internal divider 29 has an opening 30 therethrough allowing fluid to pass from the lower portion 31 into the upper portion 32. The lower opening 21, the opening 30 in the internal divider 29 and the outlet opening 12 from the top box 23 also form an annodated flow path for water through the top box 23.

As illustrated, the lower opening 21 is substantially slot shaped and is located towards the pool side of the lower portion 31 of the top box 23.

As stated above, the forward opening 25 of the top box 23 is associated with an attachment extension 27 to temporarily attach a pool cleaning device. The attachment extension 27 extends forwardly of the top box 23, into the pool away from the pool wall. The attachment extension 27 of the illustrated embodiment also functions as a valve body which is moveable in relation to the forward opening 25 and the opening 30 in the internal divider 29 of the top box 23 to regulate and prevent flow through the body portion 14 and into the outlet 12 when the pool cleaning device is attached by changing its position relative to the opening 30 in the internal divider 29 in the top box.

In the illustrated embodiment, the attachment extension is closely received within the attachment extension 27. It is elongate and tubular with an angled end located within the top box 23. The angled end provides the adjustment of the occlusion of the opening in the internal divider through rotation of the extension 27. Water can flow through the attachment extension 27 and into the tip box once the cover 28 is removed and a pool cleaner pipe 26 is attached.

Figure 11:
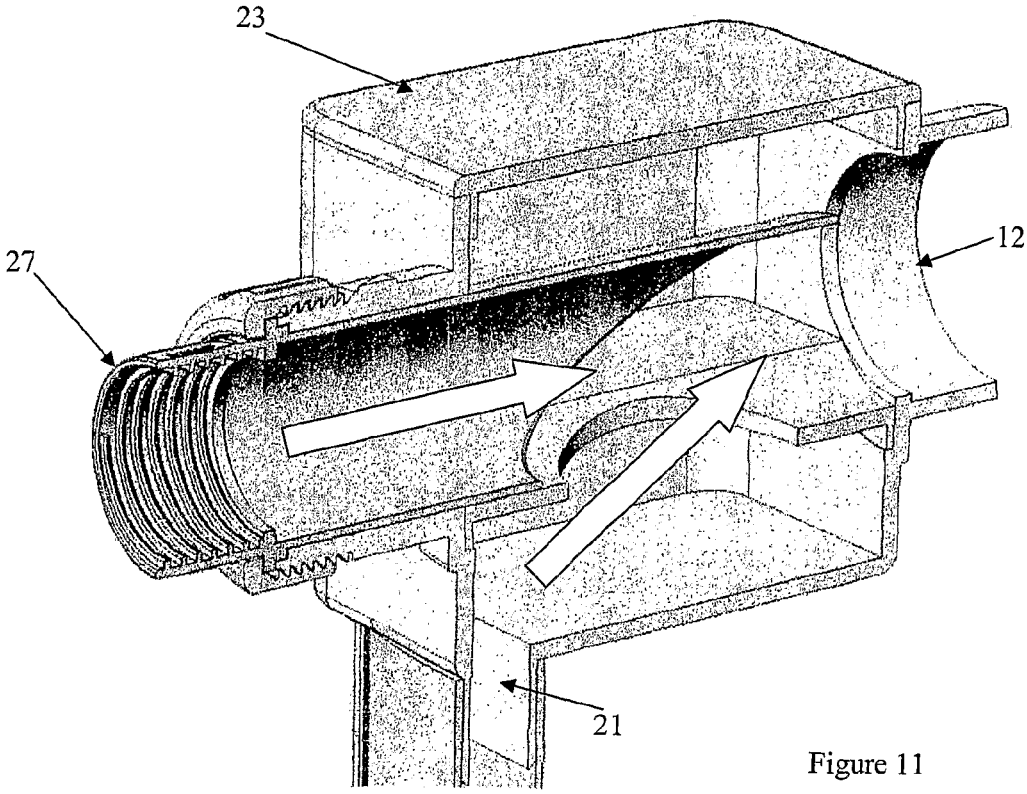
FIG. 11 is a sectional view of the top box illustrated in FIGS. 6 and 7 with the valve body in the fully open condition.

The default condition when the pool cleaning device is not connected is a fully open condition illustrated in FIG. 11 in which the opening 30 in the internal divider 29 is not restricted. It can be seen from FIG. 11 that fluid flows into the top box 23 through both the attachment extension 27 and through the opening 30 in the internal divider 29 and out of the outlet 12.

Movement of the attachment extension/valve body 27 from the fully open condition occludes the opening 30 in the internal divider 29 to an extent. A fully closed condition illustrated in FIG. 9, occludes the opening 30 entirely drawing fluid into the top box 23 through the attachment extension 27 only. A partially open condition illustrated in FIG. 10 occludes the opening 30 partially and in this manner the relative amounts of fluid drawn into the filtration system through the pool cleaning device attached to the attachment extension 27 and through the inlet manifolds 10 can be adjusted.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

The invention claimed is:

1. A flow selection device for removal of detritus from a body of water, the device including a top box having at least one outlet therefrom in communication with a filtration system and at least a pair of inlets, at least one first inlet adapted to connect a movable cleaning device and at least one second inlet in communication with a lower portion of the body of water, a substantially hollow body portion in communication with the at least one second inlet to the top box and at least one laterally extending, substantially hollow inlet arm positioned relative to a lower end of the body portion, the at least one inlet arm having at least one inlet opening therein to allow water from the body of water into the flow selection device defining an annodated flow path between the at least one inlet opening of the inlet arm and the at least one outlet from the top box.

2. A flow selection device according to claim 1 wherein the body portion is substantially the height of the body of water.

3. A flow selection device according to claim 1 wherein the top box is located above water level when attached to the body portion and the body portion is properly located in the body of water.

4. A flow selection device according to claim 1 wherein in order to connect a pool cleaner pipe, the at least one first inlet of the top box is provided with an attachment extension, one end of which is in communication with the at least one first inlet of the top box and a second end which extends forwardly of a pool wall.

5. A flow selection device according to claim 4 wherein the second end is provided with a temporary cover to cover the second end to prevent flow into and out of the attachment extension.

6. A flow selection device according to claim 4 wherein the attachment extension is provided with a valve body moveable in relation to the attachment extension and each of the at least one outlet, at least one first inlet and at least one second inlet of the top box to regulate and prevent flow through the body portion and into the at least one outlet when the pool cleaning device is attached.

7. A flow selection device according to claim 1 wherein only the at least one inlet opening and the top box are visible in a pool when installation is complete.

8. A flow selection device according to claim 1 wherein where the flow selection device is installed into an existing completed pool, the system installed attached to an interior surface of a pool wall.

9. A flow selection device according to claim 1 wherein the hollow body portion in communication with the top box extends substantially perpendicularly down the side of a pool.

10. A flow selection device according to claim 9 wherein a T-shaped centre junction is provided and attached to a lower end of the body portion with a pair of lateral extension portions each extending at approximately 90° to the body portion and along a pool wall.

11. A flow selection device according to claim 10 wherein a hollow inlet arm is connected to each lateral extension portion with an inlet opening terminus provided at the end of each inlet arm, each inlet opening terminus with an opening in communication with the body of water.

12. A flow selection device according to claim 1 wherein the top box is adjustable to optimise the water flow from the at least one first inlet adapted to connect a movable cleaning device and at least one second inlet in communication with a lower portion of the body of water to the at least one outlet in the top box.

13. A flow selection device according to claim 12 wherein a default operative condition is that the at least one outlet is in fluid communication with the at least one inlet opening.

14. A flow selection device according to claim 1 wherein the at least one second inlet is substantially slot shaped and is located towards the pool side of the top box.

15. A flow selection device according to claim 1 in communication with a filtration system in fluid communication with the body of water and which is adapted to intake water from the body of water, filter the water and then return the water to the body.

16. A flow selection device according to claim 1 wherein the top box is substantially rectangular and hollow with the at least one first inlet on a pool side adapted to connect a movable cleaning device and the at least one second inlet in communication with a lower portion of the body of water located in a lower portion of the top box and at least one outlet therefrom in communication with a filtration system located on an opposite side to the pool side.

17. A flow selection device according to claim 16 wherein the top box further includes an internal divider wall located below the plane of the at least one first inlet and the at least one outlet and dividing the top box into a lower portion into which fluid from the pool is initially drawn from the body portion through the at least one second inlet and an upper portion in which the at least one first inlet and the at least one outlet are located.

18. A flow selection device according to claim 17 wherein the internal divider has an opening therethrough allowing fluid to pass from the lower portion into the upper portion.

19. A flow selection device according to claim 18 wherein the at least one second inlet, the opening in the internal divider and the at least one outlet from the top box form an annodated flow path through the top box.

20. A flow selection device according to claim 19 wherein the at least one first inlet of the top box is provided with an attachment extension, one end of which is in communication with the at least one first inlet of the top box and a second end which extends forwardly of a pool wall, the attachment extension provided with a valve body moveable in relation to the attachment extension and the opening in the internal divider of the top box to regulate and prevent flow through the body portion and into the at least one outlet when a pool cleaning device is attached, by occluding the opening in the internal divider.

21. A flow selection device according to claim 20 wherein the default condition when the pool cleaning device is not connected is a fully open condition in which the opening in the internal divider is not occluded.

22. A flow selection device according to claim 20 wherein a fully closed condition occludes the opening in the internal divider entirely drawing fluid into the top box through the attachment extension only.

23. A flow selection device according to claim 20 wherein a partially open condition partially occludes the opening in the internal divider and in this manner the relative amounts of fluid drawn into top box through the attachment extension and thereby the pool cleaning device flow through the body portion can be adjusted.

24. A flow selection device according to claim 20 wherein the valve body is closely received within the attachment extension and is elongate and tubular to allow flow into the top box through the valve body with an angled end located within the top box adjacent the opening of the internal divider.

25. A flow selection device according to claim 20 wherein a grip means is provided on the attachment extension and which engages the valve body to move the valve body.

* * * * *